United States Patent [19]

Shekleton

[11] Patent Number: 4,944,152

[45] Date of Patent: Jul. 31, 1990

[54] AUGMENTED TURBINE COMBUSTOR COOLING

[75] Inventor: Jack R. Shekleton, San Diego, Calif.

[73] Assignee: Sundstrand Corporation, Rockford, Ill.

[21] Appl. No.: 255,965

[22] Filed: Oct. 11, 1988

[51] Int. Cl.[5] ..... F23R 3/02

[52] U.S. Cl. ..... 60/39.36; 60/757; 60/760

[58] Field of Search ..... 60/39.36, 755, 756, 60/757, 758, 759, 760

[56] References Cited

U.S. PATENT DOCUMENTS

| | | | |
|---|---|---|---|
| 3,548,565 | 12/1970 | Toesca | 60/39.36 |
| 3,793,827 | 2/1974 | Ekstedt | 60/757 |
| 3,869,864 | 3/1975 | Bunn | 60/39.36 |
| 4,180,373 | 12/1979 | Moore et al. | 415/115 |
| 4,278,400 | 7/1981 | Yamarik et al. | 416/97 R |
| 4,339,924 | 7/1982 | White et al. | 60/746 |
| 4,474,532 | 10/1984 | Pazder | 416/97 R |
| 4,515,526 | 5/1985 | Levengood | 416/97 R |
| 4,549,402 | 10/1985 | Saintsbury et al. | 60/760 |
| 4,753,575 | 6/1988 | Levengood et al. | 416/97 R |

*Primary Examiner*—Donald E. Stout
*Attorney, Agent, or Firm*—Wood,Phillips,Mason,Recktenwald & VanSanten

[57] ABSTRACT

Undesirably high and damaging temperature gradients resulting from hot spots in combustors 26 for housing a hot gas generating oxidation reaction are avoided in a construction including a combustor housing haivng a wall 32, 34, 39 with an interior surface defining a combustion space 38, 40 and an exterior surface thereof and provided with an outlet 36. A plenum 44, 80, 82 surrounds the combustor 26 and a fuel injector 50, 52 is provided for introducing a fuel to be oxidized into the combustion space 38, 40. Oxidant inlets 54 to the combustion space 38, 40 are provided and various structures including the plenum 44, 80, 82 flow cooling gas in a path about the exterior surface of the walls, 32, 34, 39 to cool the combustor housing. Trip strips 114, 118 are located on the exterior surface of the walls 32, 34, 39 and extend into the cooling gas flow path and are located to minimize the temperature gradient between points along those walls 32, 34 and 39.

6 Claims, 2 Drawing Sheets

AUGMENTED TURBINE COMBUSTOR COOLING

FIELD OF THE INVENTION

This invention relates to gas turbines, and more particularly, to improved cooling of combustors used with gas turbines.

BACKGROUND OF THE INVENTION

The desirability of eliminating hot spots in various components of turbine engines has long been known since hot spots are one cause of premature failure of engine components. In general, the approach taken has been to provide uniform temperature reduction about combustion areas through a large variety of differing techniques. While these approaches generally lower the maximum temperature to which turbine components are exposed, and thereby tend to increase the life of such components, they do not eliminate hot spots as such—they merely lower the temperature of the hot spots as well as the temperature of the area surrounding the hot spot.

As a result, substantial temperature gradients remain in existence. Since such engines are cycled between operating and nonoperating conditions as they are being utilized, and since, at nonoperating conditions, there are no temperature gradients, the presence of large temperature gradients during operation results in substantial internal stress which can cause buckling and cracking of, for example, combustor walls which ultimately leads to premature failure.

The present invention is directed to overcoming one or more of the above problems.

SUMMARY OF THE INVENTION

It is the principal object of the invention to provide a new and improved combustor for use with turbine engines which is not subject to the existence of large temperature gradients during operation. It is also an object of the invention to provide a turbine engine including such a combustor.

An exemplary embodiment of the invention achieves the foregoing object in a combustor for housing a hot gas generating oxidation reaction. The combustor includes a combustor housing having a wall with an interior surface defining a combustion space and an exterior surface oppositely thereof. A plenum is provided in surrounding relation to the combustor and means are utilized for introducing a fuel to be oxidized into the combustion space. Also provided are means for introducing an oxidant into the combustion space along with means, including the plenum, for flowing a cooling gas in a path about the exterior surface to cool the combustor housing. Trip strips are located on the exterior surface and extend into the flow path at an angle thereto and are at spaced intervals chosen so as to minimize the temperature gradients between points on the wall.

The trip strips act to induce turbulence in areas that would otherwise be subject to the presence of high temperatures and the enhanced turbulence enhances heat exchange at those locations to reduce the local temperature and thus the overall temperature gradient.

In one embodiment of the invention, the trip strips are integrally formed as ribs in the wall of the combustor while in another embodiment, they are separate strips secured thereto.

In a preferred embodiment, the means for flowing the cooling gas is operative to flow the oxidant as the cooling gas.

Preferably, the combustor is an annular combustor adapted to be located concentrically about the rotational axis of a turbine wheel which in turn is coupled to a rotary compressor to drive the same. A nozzle is provided for directing gases of combustion at the turbine wheel to cause the same to rotate about the axis. An outlet from the annular combustor is connected to the nozzle. The plenum in turn is in fluid communication with the compressor.

The invention further contemplates that ordinarily the combustor will have at least one wall provided with spaced rows of apertures with cooling strips on the interior side of the wall overlying the apertures of a corresponding row to produce a film of cooling air on the interior side from air entering the combustor through the apertures. The trip strips are located on the exterior side as mentioned previously, between the rows of apertures and are directed toward, but not to, the plenum.

In a highly preferred embodiment, the annular combustor has an inner wall and an outer wall and each are provided with the rows of apertures. The rows extend axially as do the corresponding cooling strips so that a film of cooling air moving in a circumferential direction is generated. In a highly preferred embodiment, a radial wall interconnects the inner and outer wall of the combustor and is provided with radially extending rows of apertures and radially extending cooling strips.

Other objects and advantages will become apparent from the following specification taken in connection with the accompanying drawings.

DESCRIPTION OF THE PREFERRED EMBODIMENTS

Figure 1:
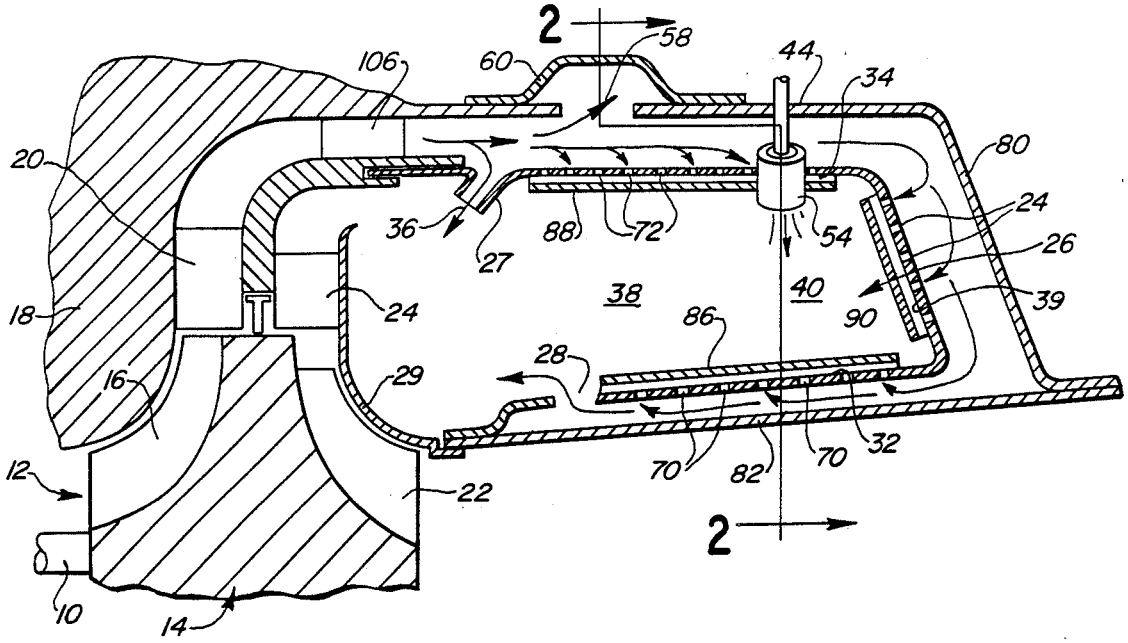
FIG. 1 is a fragmentary sectional view of a turbine engine made according to the invention.

An exemplary embodiment of a gas turbine made according to the invention is illustrated in the drawings in the form of a radial flow gas turbine. However, the invention is not so limited, having applicability to any form of turbine or other fuel combusting device requiring a combustor. The turbine includes a rotary shaft 10 journaled by bearings not shown. Adjacent one end of the shaft 10 is an inlet area 12. The shaft 10 mounts a rotor, generally designated 14, which may be of conventional construction. The rotor 14 includes a rotary compressor 15 having a plurality of compressor blades 16 adjacent the inlet 12. A compressor blade shroud 18 is provided in adjacency thereto and just radially outwardly of the radially outer extremities of the compressor blades 16 is a conventional diffuser 20.

Oppositely of the compressor blade 16, the rotor 14 includes a turbine wheel 21 having a plurality of turbine blades 22. While the compressor 15 and turbine wheel 21 are shown as being integral with each other, they may be separate and considerably spaced. In fact, they need not even be on the same axis.

In any event, just radially outward of the turbine blades 22 is an annular nozzle 24 which is adapted to receive hot gases of combustion from an annular combustor, generally designated 26. The compressor 15 including the blade 16, shroud 18 and diffuser 20 delivers compressed air to the combustor 26 and, via dilution air passages 27 and 28, to the nozzle 24 along with the gases of combustion. That is to say, hot gases of combustion from the combustor 26 are directed via the nozzle 24 against the blade 22 to cause rotation of the turbine wheel 21 and thus the compressor 15 and the shaft 10. The latter may be, of course, coupled to some sort of apparatus requiring the performance of useful work.

A turbine blade shroud 29 is interfitted with the combustor 26 to close off the flow path from the nozzle 24 and confine the expanding gas to the area of the turbine blades 22. The combustor 26 has a generally cylindrical inner wall 32 and a generally cylindrical outer wall 34. The two are concentric and merge to a necked down area or outlet 36 from an interior annulus 38 of the combustor 26 to the nozzle 24. A third wall 39, generally radially extending and concentric with the walls 32 and 34, interconnects the same to further define the annulus 38.

Oppositely of the outlet 36, and adjacent the wall 39, the interior annulus 38 of the combustor 26 includes a primary combustion zone 40. By primary combustion zone, it is meant that this is the area in which the burning of fuel primarily occurs. Other combustion may, in some instances, occur downstream from the primary combustion area 40 in the direction of the outlet 36.

As mentioned earlier, provision is made for the injection of dilution air through the passageways 27 and 28 into the combustor 26 downstream of the primary combustion zone 40 to cool the gases of combustion to a temperature suitable for application to the turbine blades 22 via the nozzle 24. It should be noted that the passageways 27 and 28 are configured so that usually the vast majority of dilution air flow into the combustor 26 occurs through the passageways 28. This, of course, requires the vast majority of dilution air to pass about the generally radially outer wall 34, the radial wall 39 and the radially inner wall 32 which in turn provides convective cooling of these combustor walls to minimize the formation of hot spots in any one of the walls 32, 34 and 39.

A further wall 44 is generally concentric to the walls 32 and 34 and is located radially outwardly of the latter. The wall 44 extends to the outlet of the diffuser 20 and thus serves to contain and direct compressed air from the compressor system to the combustor 26. The wall 44 forms part of a plenum as will be described in greater detail hereinafter.

Figure 2:
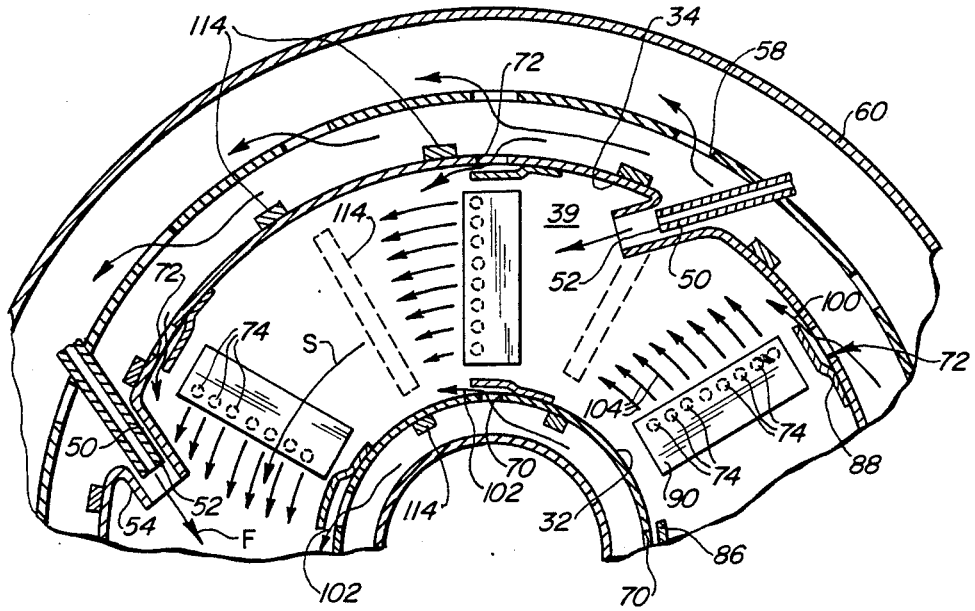
FIG. 2 is a fragmentary vertical section taken approximately along the line 2—2 in FIG. 1.

As best seen in FIG. 2, the combustor 26 is provided with a plurality of fuel injection nozzles 50. The fuel injection nozzles 50 have ends 52 disposed within the primary combustion zone 40 and which are configured to be nominally tangential to the inner wall 32. The fuel injection nozzles 50 generally, but not necessarily, utilize the pressure drop of fuel across swirl generating orifices (not shown) to accomplish fuel atomization. Tubes 54 surround the nozzles 50. High velocity air from the compressor 15 flows through the tubes 54 to enhance fuel atomization. Thus the tubes 54 serve as air injection tubes. When swirl generating orifices are not used as in the embodiment illustrated, high velocity air flowing through the tubes 54 is the means by which fuel exiting the nozzles 50 is atomized. The fuel injecting nozzles 50 are equally angularly spaced about the primary combustion zone 40 or annulus 38 in a plane that is transverse to the axis of the shaft 10.

When the intended use of the engine requires the delivery of large quantities of bleed air, the wall 44 is provided with a series of outlet openings 58 which in turn are surrounded by a bleed air scroll 60 secured to the outer surface of the wall 44. Thus, bleed air to be used for conventional purposes may be made available at the outlet (not shown) from the scroll 60.

To prevent the formation of undesirable hot spots on the walls 32, 34 and 39, which optimally are formed of sheet metal, the invention contemplates the provision of means for flowing a cooling air film over the walls 32, 34 and 39 on the interior surfaces thereof which face the annulus 38. Further, in the illustrated embodiment, there are provided means whereby the cooling air film is injected into the annulus 38 in a generally tangential, as opposed to axial, direction. Preferably the injection is provided along each of the walls 32, 34 and 39 but in some instances, such injection may occur on less than all of such walls as desired.

In the case of the radially inner wall 32, the same is provided with a series of apertures or rows of apertures 70. Preferably, the apertures 70 are arranged in a series of equally angularly spaced, generally axially extending rows. Thus, the three apertures 70 shown in FIG. 2 constitute one aperture in each of three such rows while the apertures 70 illustrated in FIG. 1 constitute the apertures in a single such row.

A similar series of equally angularly spaced, axially extending rows of apertures 72 is likewise provided in the wall 34.

In the case of the wall 39, there are a series of generally radially extending rows of apertures 74. As can be readily appreciated, the apertures 70, 72 and 74 establish fluid communication between the interior of the combustor 26 and the plenum defined by the wall 44 and connecting walls 80 and 82.

Figure 3:
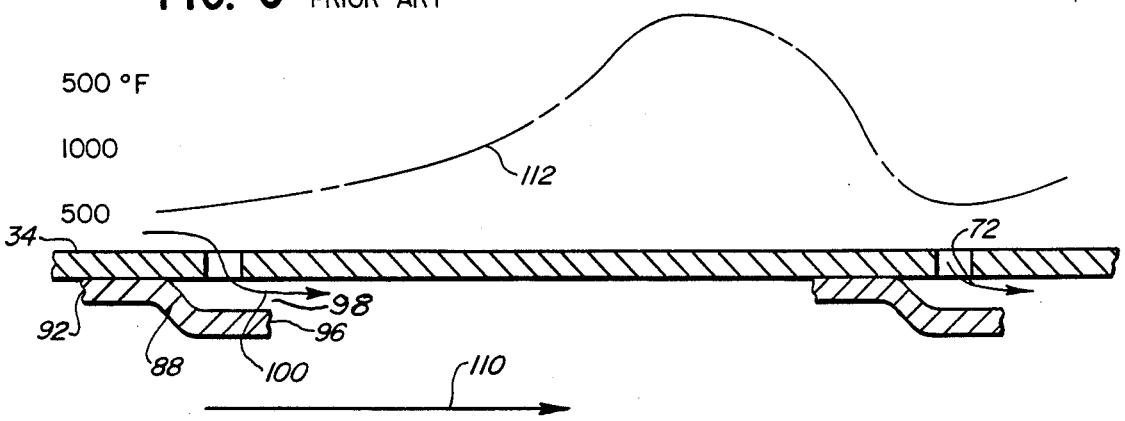
FIG. 3 PRIOR ART
FIG. 3 is a somewhat schematic, enlarged, fragmentary view of a conventional combustor wall graphing the temperature along the wall in the direction of the flow of hot gas with respect thereto.

Cooling strips 86, 88 and 90 are respectively applied to the rows of apertures 70, 72 and 74 in the walls 32, 34 and 39 on the interior surfaces thereof. As a consequence of this construction, tangential and film-like streams of cooling air enter the annulus 38 in a generally circumferential direction. Air flowing in the plenum about the exterior of the combustor 26 will remove heat therefrom by external convective cooling of the walls 32, 34 and 39 while the cooling air film on the interior sides of the walls 32, 34 and 39 resulting from film-like air flow through the apertures 70, 72 and 74 minimizes the input of heat from the flame within the combustor 26 during the burning of fuel therein to the walls 32, 34 and 39. Thus, in the preferred embodiment, the entirety of the internal surface of all of the walls 32, 34 and 39 is completely covered with a film of air. This film further serves to minimize carbon buildup and the elimination of hot spots on the combustor walls. These advantages are obtained in part by reason of the jets of air which result from the air flow through the apertures 70, 72 and 74 which impact upon the cooling strips 86, 88 and 90 to cool them. The cooling strips 86, 88 and 90 also act as local barriers to convective and radiative heating of the walls 32, 34 and 39 by the flame burning within the combustor 26. The cooling strips 86, 88 and 90 are generally similar to one another and as seen in FIG. 3, are seen to be in the shape of a generally flatted S having an upstream edge 92 bonded to, for example, the wall 34 by any suitable means such as a braze or a weld (not shown). Because of the S shape of the cooling strip 88, this results in the opposite or downstream edge 96 being spaced from the opening 70 with an exit opening 98 being formed.

The exit opening 98 is elongated in the axial direction along with the edge 96 and also opens generally tangentially to the wall 34. Consequently, air entering the annulus 38 through the openings in the direction of arrows 100 (FIGS. 2 and 3) will flow in a film-like fashion in a generally tangential direction along the wall 34 on its interior surface to cool the same. The flow is, of course, in the same direction as the direction of injection of fuel and primary air. The air flow indicated by arrows 102 in FIG. 2 illustrate the corresponding, tangential film-like flow of cooling air on the interior of the wall 32 while additional arrows 104 in FIG. 2 illustrate a similar, circumferential or tangential film-like air flow of air entering the opening 74 in the wall 39.

Without more, the temperature at corresponding locations in the direction of air flow indicated by an arrow 110 in FIG. 3 of the wall 34 may be as graphed by the line 112. As can be seen, a gradient of 1,000° F. or more may exist from a cool area immediately adjacent a row of apertures 72 to the hottest area just upstream of the next row of apertures 72. This will also generally hold true for the walls 32 and 39 and the apertures 70, 74 therein. This is due to the fact that combustion occurring on the interior of the combustor tends to break up the film 100 in part and also to heat up the air comprising the film 100 so that heat transfer is progressively minimized as one proceeds downstream from any given cooling strip 88.

Figure 4:
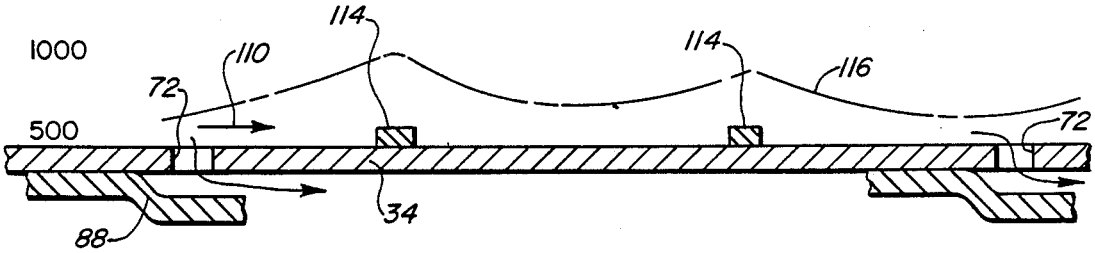
FIG. 4 is a view similar to FIG. 3 but of a preferred embodiment of the invention.

According to the invention, such temperature gradients can be reduced to magnitudes of well under 500° F. by the addition of trip strips 114 (FIG. 4) to the exterior surfaces of the walls 32, 34 and 39 (see also FIG. 2). The trip strips, in the embodiment of FIG. 4, are elongated, relatively narrow strips of metal which are brazed to the exterior surface of the corresponding wall. They extend preferably generally transverse to the direction of air flow in the plenum defined by the walls 44, 80 and 82 and generally extend toward the corresponding one of those walls but stop well short thereof. Air flowing within the plenum will strike the trip strips and eddy currents with increased turbulence downstream of the trip strips 114 will result. The increased turbulence means increased Reynolds Numbers and that in turn means increased heat transfer to the air within the plenum which in turn means a reduction in the temperature in the walls 32, 34, 39 in the area whereat the heat transfer has been enhanced.

According to the invention, the trip strips 114 are advantageously located between rows of the apertures in the walls 32, 34 or 39 not so much to achieve a reduction in the temperature along the entire length of such walls, but rather, so as to minimize the temperature gradient. Thus, FIG. 4 illustrates two of the trip strips 114 located on the wall 34 at about those locations where the wall temperature would begin to increase over 1,000° F. as illustrated by a line 116 graphing temperature along the length of the wall 34.

Stated another way, the trip strips 114 are judiciously located only where the wall temperature begins to increase to a value exceeding the minimum wall temperature by an amount that would exceed the maximum permissible temperature gradient. Thus FIG. 4 illustrates a construction wherein the temperature gradient is less than 500° F., with a temperature ranging somewhere between 500–1,000° F. If additional trip strips were employed as, for example, immediately adjacent a row of apertures 72, the lower limit of the temperature range could well be reduced. However, that would not necessarily reduce the upper limit of the temperature range; and where that would be the case, the temperature gradient could be undesirably large. This then stresses that the invention seeks to reduce the temperature gradient through judicious locating of the trip strips 114 and is not concerned with employing an unduly large number of such trip strips so as to reduce the lower limit of the temperature range.

Thus, depending upon the particular geometry of a given combustor as well as the maximum permitted temperature gradient in a given combustor, greater or lesser numbers of the trip strips 114 as between adjacent rows of apertures may be employed. In those instances where hot spot locations can be readily identified, the trip strip can be located immediately upstream of such hot spots and disposed at an angle of about 90° in the direction of air flow. In such a case, the trip strips will have a length that corresponds to the width of the hot spot and the same will be cooled as is desired. The degree to which cooling of such a hot spot occurs may be regulated by suitable choosing the height of the trip strip 114, that is, the degree to which it projects upwardly from the surface on which it is mounted into the flowing air stream. Greater heights will tend to produce greater turbulence and thus higher Reynolds numbers and increased heat transfer for high cooling whereas shorter heights can be used where such a great degree of cooling is not required.

Figure 5:
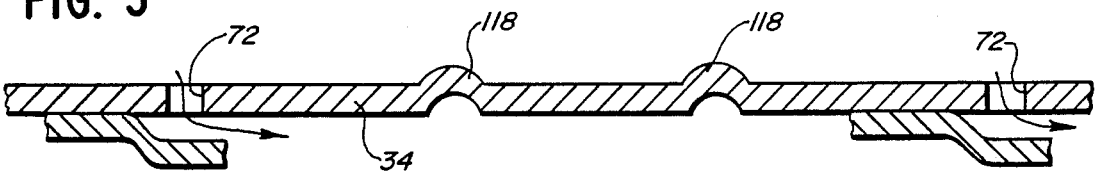
FIG. 5 is a view similar to FIGS. 3 and 4 but illustrating a modified embodiment of the invention.

FIG. 5 illustrates a modified embodiment. In the embodiment of FIG. 5, the trip strips are not separate from the wall 34 but rather, are integrally formed as elongated ribs 118 therein. Such can be advantageously accomplished when the wall 34 is made of sheet metal as is usually the case.

In general, by adjusting the height, length and spacing of the trip strips 114 and 118, extremely fine control of temperature gradients may be obtained. By appropriate location of the trip strips 114 and 118, unduly large, undesirable and damaging temperature gradients that can cause buckling and/or cracking, and thus failure of the combustor walls, may be avoided through the inexpensive use of the trip strips.

I claim:

1. A turbine engine comprising:

a rotary compressor;

a turbine wheel rotatable about an axis and coupled to the rotary compressor to drive the same;

a nozzle for directing gases of combustion at said turbine wheel to cause the same to rotate;

an annular combustor centered on said axis and having an outlet connected to said nozzle, said combustor having at least one wall having an interior side and an exterior side and provided with spaced rows of apertures to produce a film of cooling air on said interior side from air entering said combustor through said apertures;

a plenum substantially surrounding said combustor and in fluid communication with said compressor and for delivering compressed air therefrom to said apertures; and trip strips on said exterior side between said rows of apertures and directed toward, but not to, said plenum, said trip strips being located to minimize the temperature gradient between spaced locations located in turn between adjacent rows of apertures.

2. The turbine engine of claim 1 wherein said combustor is fabricated of sheet metal and said trip strips are defined by integral ribs in sheet metal forming said wall.

3. The turbine engine of claim 1 wherein said combustor is fabricated of metal and said trip strips are defined by metal strips secured to the metal forming said wall.

4. The turbine engine of claim 3 wherein the metal strips are brazed to said wall.

5. A turbine engine comprising:

a rotary compressor;

a turbine wheel rotatable about an axis and coupled to the rotary compressor to drive the same;

a nozzle for directing gases of combustion at said turbine wheel to cause the same to rotate;

an annular combustor formed of sheet metal centered on said axis and having an outlet connected to said nozzle, said combustor having an inner and an outer wall each having an interior side and an exterior side and provided with spaced, axially extending rows of apertures and axially extending cooling strips on the interior side of said wall overlying the apertures of a corresponding row to produce a circumferentially directed film of cooling air on said interior side from air entering said combustor through said apertures;

a plenum substantially surrounding said combustor and in fluid communication with said compressor and for delivering compressed air therefrom to said apertures; and trip strips on said exterior sides of said walls between said rows of apertures and directed toward, but not to, said plenum, said trip strips being located to minimize the temperature gradient between spaced locations located in turn between adjacent rows of apertures.

6. The turbine engine of claim 5 wherein said combustor includes a radial wall opposite said outlet, within said plenum and extending between said inner and outer walls; generally radially directed rows of apertures in said radial wall and generally radially directed cooling strips overlying the rows of apertures in said radial wall for directing air entering the combustor through the apertures of the radial rows generally circumferentially as a film of cooling air; and trip strips on the exterior side of said radial wall between said radially extending rows of apertures.

* * * * *